US006120309A

United States Patent [19]

Hara

[11] Patent Number: 6,120,309

[45] Date of Patent: Sep. 19, 2000

[54] ELECTRICAL CONNECTOR

[75] Inventor: Tomohisa Hara, Nagano-Ken, Japan

[73] Assignee: Hon Hai Precision Ind. Co., Ltd., Taipei Hsien, Taiwan

[21] Appl. No.: 09/266,244

[22] Filed: Mar. 10, 1999

[30] Foreign Application Priority Data

Mar. 10, 1998 [TW] Taiwan ..... 87203517

[51] Int. Cl.[7] ..... H01R 13/62

[52] U.S. Cl. ..... 439/159; 439/157

[58] Field of Search ..... 439/157, 159, 439/259, 372, 325, 152, 153, 154, 155, 156, 158, 160

[56] References Cited

U.S. PATENT DOCUMENTS 5,161,989 11/1992 Okubo et al. ..... 439/159
5,179,505 1/1993 Matsuo ..... 361/395
5,286,207 2/1994 McHugh ..... 439/64
5,304,070 4/1994 Bertho et al. ..... 439/157
5,451,168 9/1995 Shuey ..... 439/159
5,899,763 5/1999 Kajiura ..... 439/159

*Primary Examiner*—Paula Bradley
*Assistant Examiner*—Alexander Gilman
*Attorney, Agent, or Firm*—Wei Te Chung

[57] ABSTRACT

An electrical connector includes a connection portion for engaging an electronic card and a two-phase card release mechanism for releasing the card from the connection portion. The card release mechanism includes a rocking arm which is manually actuated to rotate about a fixed central pivot point for driving a drawer plate rotatably connected to an end thereof to linearly move a first distance. This is the first phase and the card is moved the first distance with the drawer plate. A further rotation of the rocking arm causes the drawer plate to rotate therewith which drives the card engaged by the drawer plate to move a further distance. This is the second phase.

10 Claims, 4 Drawing Sheets

ELECTRICAL CONNECTOR

FIELD OF THE INVENTION

The present invention generally relates to a connector and in particular to a card connector which performs a two phase card release operation resulting in a great displacement of the card when releasing the card from the connector.

THE PRIOR ART

Electrical connectors for receiving and electrically connecting an electronic card are well known. To release the card from the connector, the connector is usually provided with a card release mechanism. Examples of card release mechanisms are disclosed in Taiwan Patent Application Nos. 82101136 and 82102557 and U.S. Pat. Nos. 5,051,101 and 5,139,435. A common disadvantage of these designs is that they perform a single phase card release operation resulting in only a small displacement of the card so that in cases where the card connector is located deep inside a computer casing, the card may not be moved outward a sufficient distance to allow a user to access the card.

It is thus desirable to have a connector equipped with a card release device which performs a card release operation having an additional phase that provides the card with a second displacement so that the overall release distance of the card is increased and the problem encountered in the prior art is overcome.

SUMMARY OF THE INVENTION

Therefore, an object of the present invention is to provide a connector comprising a two phase card release mechanism which performs a release operation having two phases each causing the card to move outward a distance and as a consequence, a greater overall card release distance may be obtained.

To achieve the above object, an electrical connector in accordance with the present invention comprises a connection portion for engaging an electronic card and a two phase card release mechanism for releasing the card from the connection portion in two phases. The card release mechanism comprises a rocking arm having a fixed pivot point, and two movable pivot points on two opposite sides and respectively coupled to a manually operable release bar and a drawer plate. The drawer plate has two ends engageable with an electronic card received in the connector and the pivot between the rocking arm and the drawer plate is located on the drawer plate at a position between the ends thereof so that actuating the release bar causes the rocking arm to rotate about the fixed pivot point which in turn drives the drawer plate to move in a linear translation fashion. This performs the first phase of the card release operation and the card is moved a first distance. The drawer plate is provided with a projection and the rocking arm is provided with a corresponding abutting edge which is brought to contact the projection at the end of the first phase. Further actuating the release bar causes the drawer plate to rotate with the rocking arm due to the contact engagement and the pivot point therebetween. The second phase of the release operation is thus performed with the rotation of the drawer plate which causes one end of the drawer plate to move thereby driving the card outward a second distance.

BRIEF DESCRIPTION OF THE DRAWINGS

The present invention will be apparent to those skilled in the art by reading the following description of a preferred embodiment thereof, with reference to the accompanying drawings, in which:

FIGS. 3A–3C are sequential views showing the two phase card release operation performed by the present invention, wherein FIG. 3A is the initial condition, FIG. 3B is the first phase and FIG. 3C is the second phase.

DETAILED DESCRIPTION OF THE PREFERRED EMBODIMENTS

Figure 1:
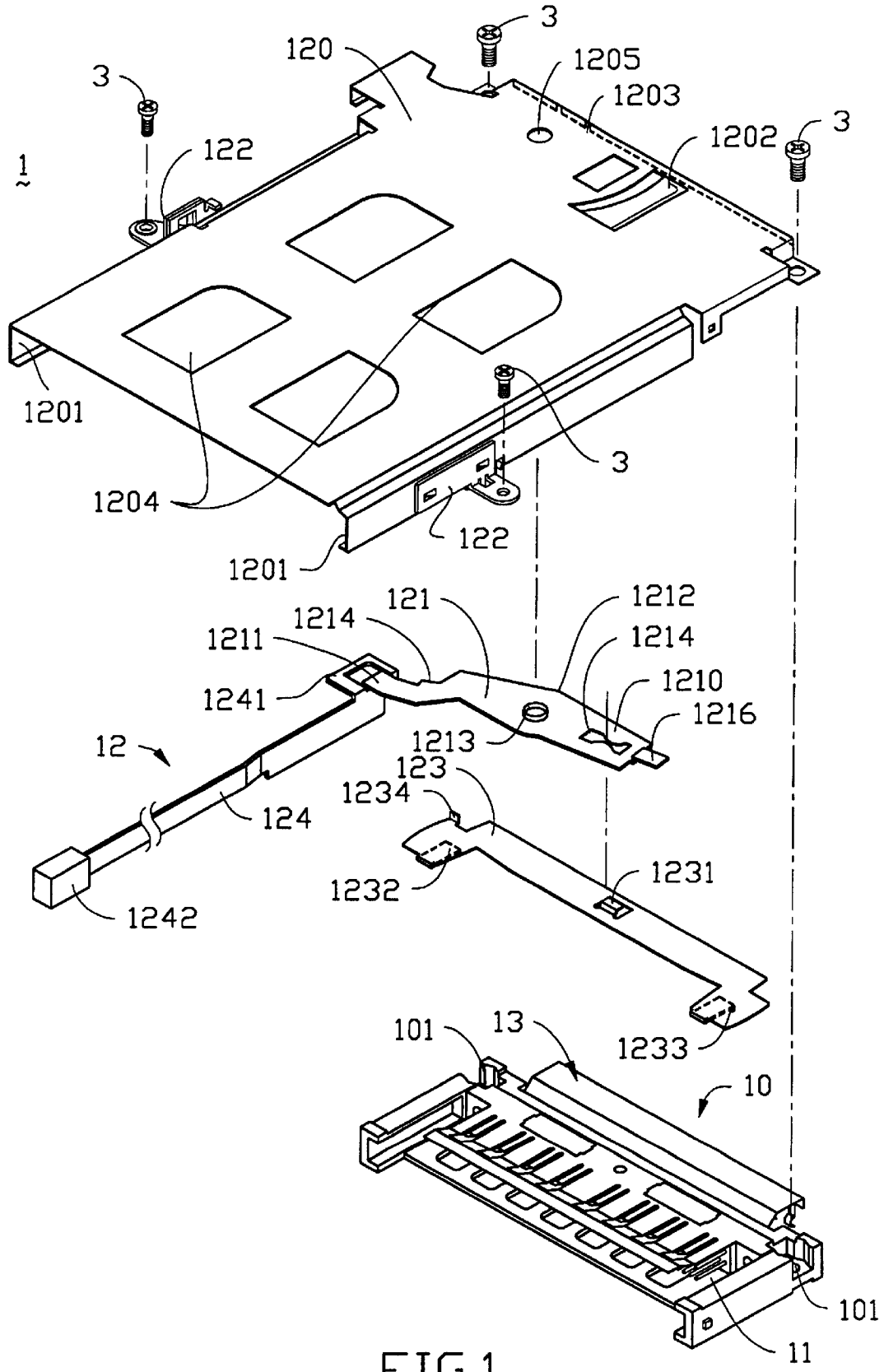
FIG. 1 is an exploded perspective view of an electrical connector constructed in accordance with the present invention.
Figure 2:
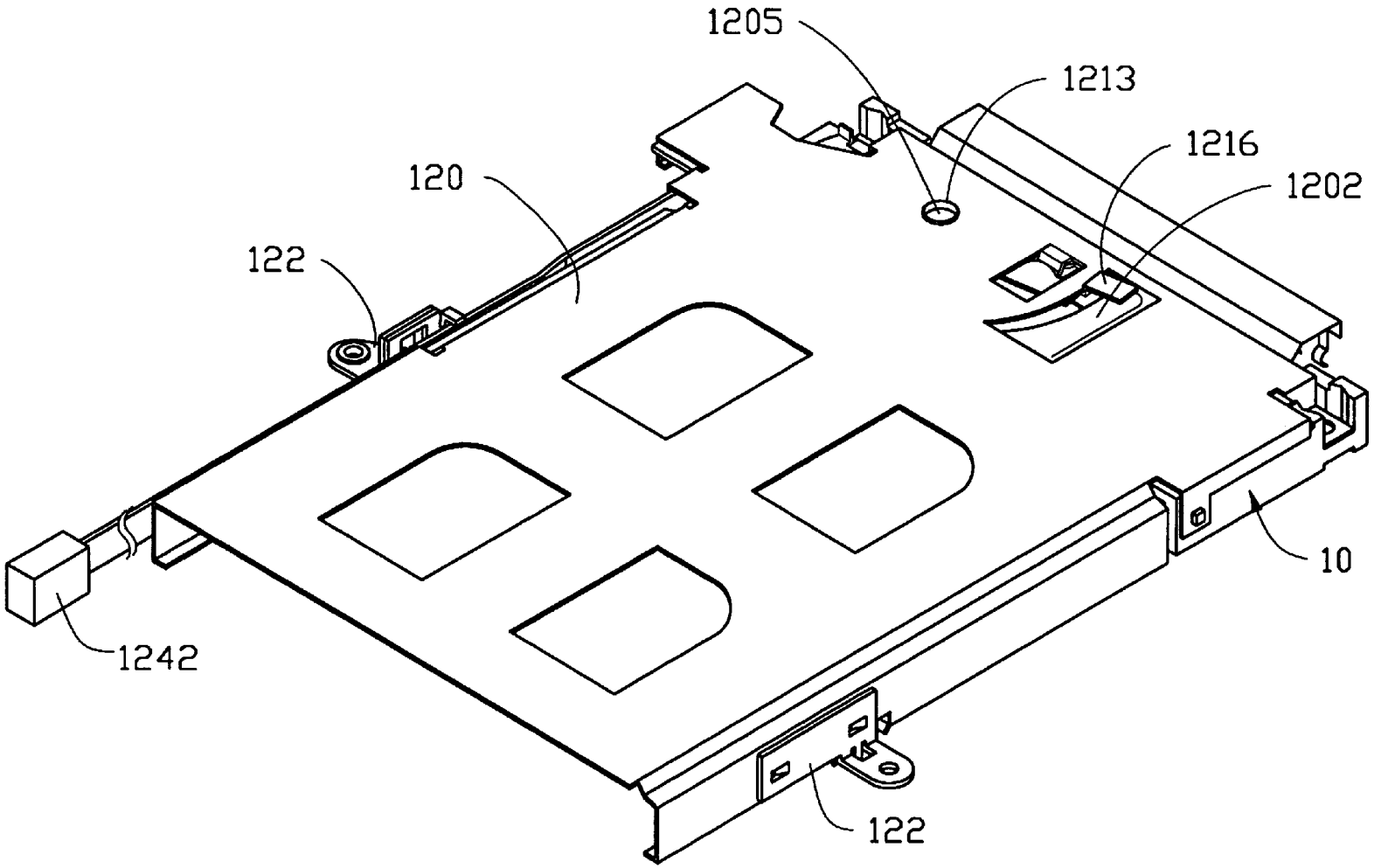
FIG. 2 is an assembled view of FIG. 1.

With reference to the drawings and in particular to FIGS. 1 and 2, an electrical connector 1 in accordance with the present invention comprises a U-shaped connector body 10 including a plurality of terminal pins 11 arranged on a bottom portion thereof. The terminal pins 11 are engageable with an electronic card (not shown) to establish electrical connection therewith. The connector body 10 has bolt holes 101 defined through two side portions thereof for mounting to a circuit board (not shown) by means of bolts or screws. A shielding member 13 is disposed on the bottom portion of the connector body 10.

The connector 1 further comprises a card release mechanism 12 which comprises an anchoring plate 120, a rocking arm 121, a drawer plate 123 and a manual release bar 124.

The anchoring plate 120 is preferably of a size corresponding to the electronic card to be received in the connector 1, and comprises two spaced and opposite side walls, each defining a guide slot 1201 for receiving opposite side edges of the electronic card therein thus guiding the electronic card into/out of the connector 1. The anchoring plate 120 is also provided with mounting means, comprising a lug 122 fixed to each of the side walls of the anchoring plate 120 for receiving a bolt 3 in a hole defined therethrough to fix the anchoring plate 120 to a computer casing (not shown).

Heat dissipation openings 1204 are defined in the anchoring plate 120 for facilitating efficient removal of heat generated in the electronic card.

The rocking arm 121 comprises an elongate plate member having a first end 1210 to which the drawer plate 123 is pivotably connected and a second end 1211 to which the release bar 124 is rotatably connected. The rocking arm 121 has a pivot pin 1213 between the first end 1210 and the second end 1211 which is rotatably received in a hole 1205 defined in the anchoring plate 120 so as to allow the rocking arm 121 to rotate with respect to the anchoring plate 120. This allows an inward movement of the release bar 124 caused by manually actuating or depressing a manual push button 1242 provided on an outer end of the release bar 124 to be transmitted to the drawer plate 123 by means of the rotation of the rocking arm 121 about the pivot 1213. The drawer plate 123 is thus moved in an outward direction resulting in an outward displacement of the electronic card. This constitutes a first phase of the card release operation. A second phase of the card release operation causes a further outward displacement of the electronic card.

In the embodiment illustrated, the pivotal connection between the first end 1210 of the rocking arm 121 and the drawer plate 123 comprises a slot 1214 defined proximate the first end 1210 of the rocking arm 121 within which a projecting tab 1231 formed at approximately a middle of the drawer plate 123 is received. The slot 1214 has two arced sides opposing each other and defining a slit therebetween which pinchingly receives the tab 1231 therein. The tab 1231 is engaged between the arced sides which serve as a pivot point thereby allowing the tab 1231 and thus the drawer plate 123 to rotate with respect to the rocking arm 121 about the pivotal engagement between the tab 1231 and the arced sides of the slot 1214 of the rocking arm 121.

The drawer plate 123 has two ends on which a first L-shaped member 1232 and a second L-shaped member 1233 are respectively mounted. The L-shaped members 1232, 1233 are mounted to the ends of the drawer plate 123 so that the L-shaped members 1232, 1233 are drivingly engageable with the electronic card at positions proximate the two side edges thereof so that the outward movement of the drawer plate 123 moves the electronic card outward.

The rotatable connection between the second end 1211 of the rocking arm 121 and the release bar 124 comprises an opening 1241 formed on an inner end of the release bar 124 for receiving the second end 1211 of the rocking arm 121 therein. In this respect, the second end 1211 of the rocking arm 121 may be provided with an extension, preferably substantially normal to the rocking arm 121, rotatably received in the opening 1241 of the release bar 124.

The first end 1210 of the rocking arm 121 comprises an extension 1216 which may be offset with respect to a plane of the rocking arm 121. The anchoring plate 120 defines a guide slot 1202 into which the extension 1216 of the rocking arm 121 is movably and guidingly received. The guide slot 1202 of the anchoring plate 120 guides the movement of the rocking arm 121.

The rocking arm 121 forms an abutting edge 1215 adjacent to the second end 1211 and the drawer plate 123 is provided with a projection 1234 which is preferably located proximate one end of the drawer plate 123. The abutting edge 1215 and the projection 1234 are positioned such that when the first phase release operation is complete, the abutting edge 1215 is brought to contact with the projection 1234 of the drawer plate 123. The engagement between the rocking arm 121 and the drawer plate 123, together with the pivotal connection therebetween fixes the drawer plate 123 to the rocking arm 121 in a further inward movement of the release bar 124 which causes the rocking arm 121 to further rotate and the drawer plate 123 rotates with the rocking arm 121. The rotation of the drawer plate 123 causes one of the ends of the drawer plate 123 opposite the projection 1234 to move further outward. Thus a second displacement is imposed on the electronic card which constitutes the second phase of the card release operation performed by the card release mechanism of the present invention.

Figures 3A, 3B, 3C:
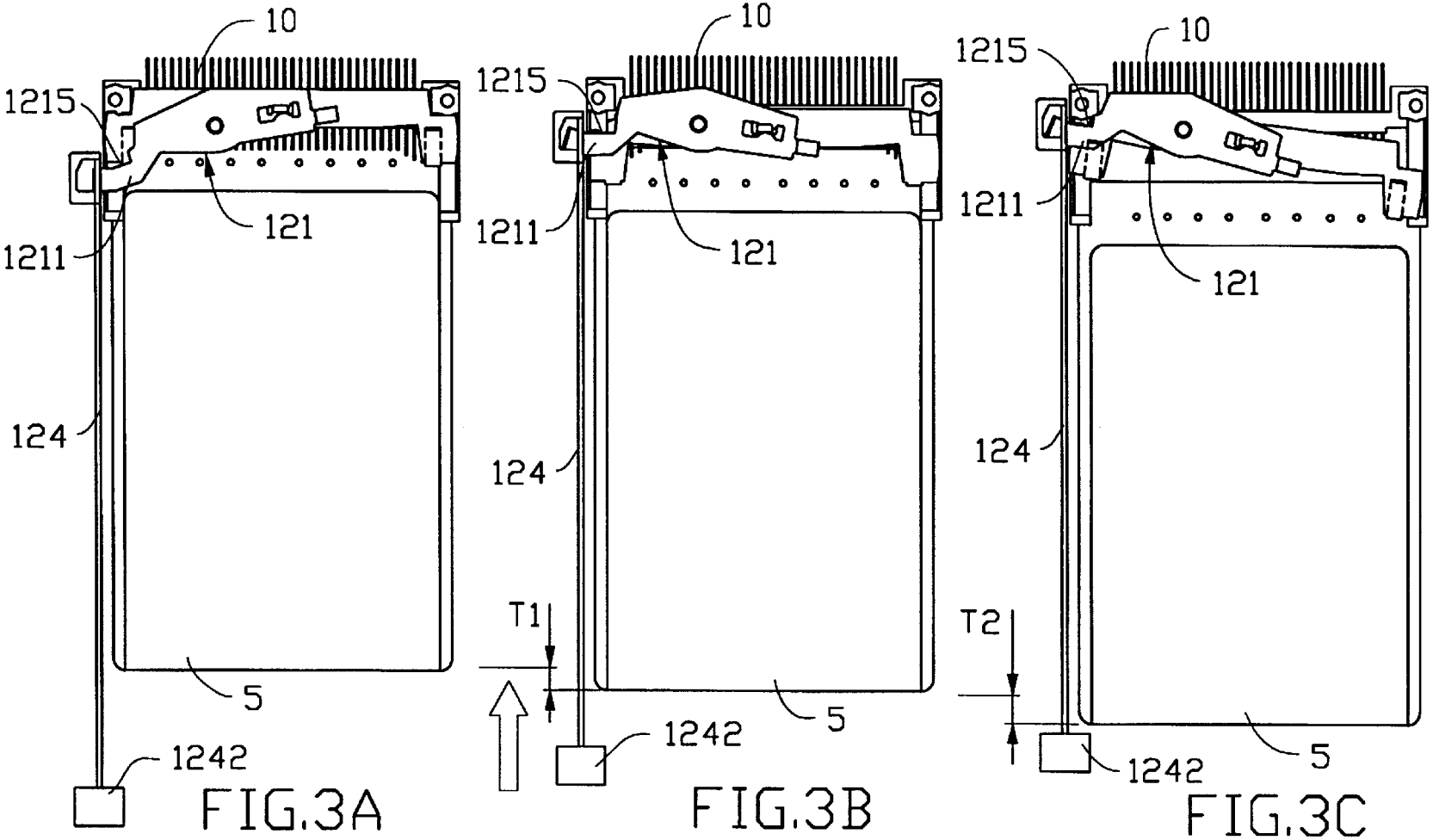

The two-phase card release operation is sequentially shown in FIGS. 3A–3C. FIG. 3A shows an initial phase wherein an electronic card 5 is received in and connected to the connector 1. In FIG. 3B, the release bar 124 is pushed inward which causes the rocking arm 121 to rotate and drive the drawer plate 123 to move outward substantially in a translation fashion to a position where the abutting edge 1215 of the rocking arm 121 contacts the projection 1234 of the drawer plate 123. An outward displacement T1 of the electronic card 5 is thus achieved. This is the first phase of the card release operation. In FIG. 3C, the release bar 124 is further pushed inward and as discussed above, the drawer plate 123 rotates with the rocking arm 121 and one of the ends of the drawer plate 123 on which the projection 1234 is formed is moved inward with the release bar 124 and the opposite end of the drawer plate 123 is moved further outward thereby resulting in a second displacement T2 of the electronic card 5. This is the second phase of the card release operation in accordance with the present invention.

Figure 4A:
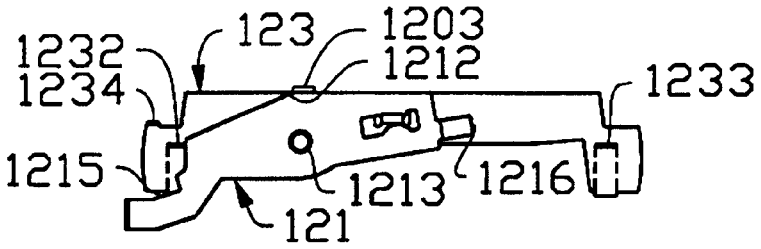
FIGS. 4A–4C are schematic views showing the relationship between the rocking arm and the drawer plate respectively corresponding to FIGS. 3A–3C.
Figure 4B:
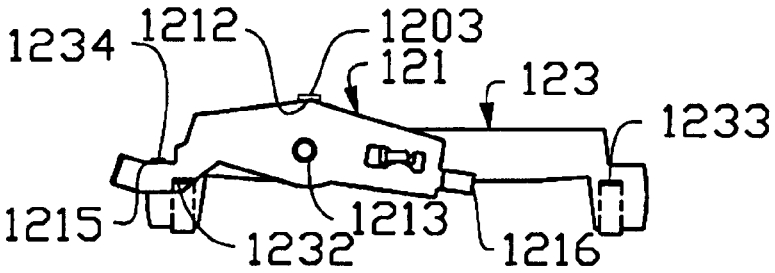
Figure 4C:
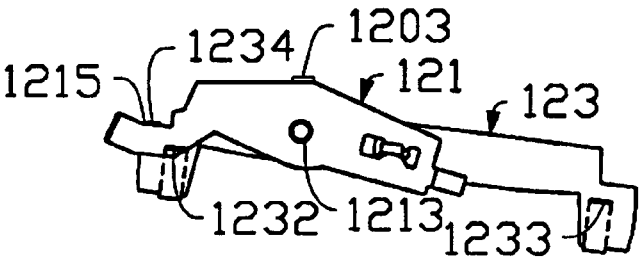

It is noted that above each of the FIGS. 4A–4C, a schematic view is provided to indicate the relationship between the rocking arm 121 and the drawer plate 123. As shown in FIGS. 4B and 4C, once the abutting edge 1215 of the rocking arm 121 contacts the projection 1234 of the drawer plate 123, further inward movement of the release bar 124 causes the drawer plate 123 to rotate with the rocking arm 121.

The rocking arm 121 is provided with an expanded portion 1212 which is positioned to contact a support flange 1203 provided on the anchoring plate 120 thereby providing a support to the rocking arm 121 during rotation about the pivot 1213. The expanded portion 1212 is configured such that no constraint is imposed on the rotation of the rocking arm 121 about the pivot 1213.

It should be noted that the invention includes several features. First, during the first phase of card release operation, the drawer plate 123 abuts against the card 5 at two points, i.e., the L-shaped members 1232, 1233. Oppositely, during the second phase of card release operation, the drawer plate abuts against the card 5 at only one points, i.e. the L-shaped member 1233 which is distanced farther from the pivotal pin 1213 than the other L-shaped member 1232.

Secondly, from another viewpoint during the first phase of card release operation, the drawer plate 123 is only activated by one point, i.e., the slot 1214 of the rocking arm 121 or the tab 1231 of the drawer plate 123, while during the second phase thereof, the drawer plate 123 are activated by two opposite points wherein one is the aforementioned slot 1214 of the rocking arm 121 or tab 1231 of the drawer plate 123, and the other is the abutting edge 1215 of the rocking arm 121 or the projection 1234 of the drawer plate 123.

Thirdly, still from another viewpoint during the first phase of card release operation, the drawer plate 123 moves in a linear direction, while during the second phase of card release operation, the drawer plate 123 rotates around the pivotal pin 1213 instead of the linear movement.

Fourth, still from another viewpoint, in the invention the pivotal point is formed by the immovable pivotal pin 1213 during either phase, while a longer force arm is provided by the drawer plate 123 and is defined between the L-shaped member 1233 thereof and the pivotal pin 1213 of the rocking arm 121 during the second phase in place of a shorter force arm which is provided by the rocking arm 121 and is defined between the pivotal connection portion, i.e., the first end 1210, and the pivotal pin 1213 of the rocking arm 121 during the first phase. Thus, the card can be actuated to move a relatively longer distance when the release bar 124 moves a shorter distance during the second phase.

Although the present invention has been described with reference to a preferred embodiment, it is apparent to those skilled in the art that a variety of modifications and changes may be made without departing from the scope of the present invention which is intended to be defined by the appended claims.

What is claimed is:

1. An electrical connector comprising:

a connector body adapted to receive and electronic card therein; and a two phase card release mechanism, comprising:

an anchoring plate adapted to be fixed to an external fixed member;

a rocking arm pivotally attached to the anchoring plate at a plate to be rotatable with respect thereto, the rocking arm having a first end, an opposite second end and a second phase release means adjacent to the second end, the point being located between the first end and the second phase release means;

a drawer plate having a pivotal connection with the first end of the rocking arm at about a middle of the drawer plate, the drawer plate being movable with the respect to the connector body, the drawer plate comprising a counterpart release means of the rocking arm; and a release bar having an outer end adapted to be actuated by a user to move the release bar inward and an inner end rotatably coupled to the second end of the rocking arm;

wherein during a first phase of card release operation the inward movement of the release bar causes the rocking arm to rotate which drives the drawer plate outward a first distance via the pivotal connection between the rocking arm and the drawer plate imposing a first displacement on the electronic card, and the second phase release means of the rocking arm is brought to contact the counterpart release means of the drawer plate so that during a second phase of the card release operation when the release bar is moved further inward, the engagement between the second phase release means and the counterpart release means causes the drawer plate to rotate with the rocking which in turn causes an end of the drawer plate opposite to the counterpart release means to move further outward a second distance thus imposing a second displacement on the electronic card;

wherein the second phase release means on the rocking arm comprises an abutting edge formed on the rocking arm and wherein the counterpart release means on the drawer plate comprises a section provided on the drawer plate which is drivingly engageble by the abutting edge of the rocking arm so that the engagement between the section of the drawer plate and the abutting edge of the rocking arm and the pivotal connection between the drawewr plate and the rocking arm causes the drawer plate to rotate with the rocking arm in the second phase of the card release operation.

2. The electrical connector as claimed in claim 1, wherein the pivotal connection between the rocking arm and the drawer plate comprises a first slot defined in the rocking arm having two arced sides facing each other to define a slit therebetween, the drawer plate forming a tab received in the slit and engaged by the arc sides.

3. The electrical connector as claimed in claim 1, wherein the rotatable coupling between the release bar and the rocking arm comprises a first opening formed on the release bar within which an extension of the rocking arm is rotatably received.

4. The electrical connector as claimed in claim 1, wherein the rocking arm comprises an offset extension which is movably received in a second slot formed on the anchoring plate for guiding the rotation of the rocking arm.

5. The electrical connector as claimed in claim 1, wherein the rocking arm comprises an expanded section which engages a support flange provided on the anchoring plate such that the rocking arm is allowed to rotate about the pivot thereof while providing support during the rotation of the rocking arm.

6. The electrical connector as claimed in claim 1, wherein the anchoring plate defines second openings for heat dissipation purposes.

7. The electrical connector as claimed in claim 1, wherein the anchoring plate comprises a plurality of lugs each defining a hole therein for receiving a bolt for fixing the anchoring plate to the external fixed member.

8. A two-phase card release mechanism adapted to be incorporated in a card connector to release a card from the connector, comprising:

a rocking arm having a fixed pivot point about which the rocking arm is rotatable, the rocking arm having a first end, an opposite second end and a second phase release means adjacent to the second end, the pivot point being located between the first end and the second phase release means;

a drawer plate pivotably connected to the first end of the rocking arm at about a middle of the drawer plate, the drawer plate being engageable with the card and movable so as to displace the card with respect to the connector, the drawer plate comprising a counterpart a counterpart release means corresponding to the second phase release means of the rocking arm; and a release bar having a first end adapted to be actuated by a user to move the release bar inward and a second end rotatably coupled to the second end of the rocking arm;

wherein in a first phase of card release operation, the inward movement of the release bar causes the rocking arm to rotate which drives the drawer plate outward a first distance via the pivotal connection between the rocking arm and the drawer plate which imposes a first displacement on the card, and the second phase release means of the rocking arm is brought into contact and driving engagement with the counterpart release means of the drawer plate so that during a second phase of the card release operation when the release bar is moved further inward, the engagement between the second phase release means and the counterpart release means causes the drawer plate to rotate with the rocking which in turn causes an end of the drawer plate opposite to the counterpart release means to move further outward a second distance thus imposing a second displacement on the card;

wherein the second phase release means on the rocking arm comprises an abutting edge formed on the rocking arm and wherein the counterpart release means on the drawer plate comprises a section provided on the drawer plate which is drivingly engageble by the abutting edge of the rocking arm so that the engagement between the section of the drawer plate and the abutting edge of the rocking arm and the pivotal connection between the drawewr plate and the rocking arm causes the drawer plate to rotate with the rocking arm in the second phase of the card release operation.

9. The electrical connector as claimed in claim 8, wherein the pivotal connection between the rocking arm and the drawer plate comprises a slot formed on the rocking arm having two arc sides facing each other to define a slit therebetween, the drawer plate comprising a tab received in the slit and engaged by the arc sides.

10. The electrical connector as claimed in claim 8, wherein the rotatable coupling between the release bar and the rocking arm comprises an opening defined in the release bar within which an extension of the rocking arm is rotatably received.

* * * * *